US007621397B2

(12) United States Patent
Boudrie et al.

(10) Patent No.: US 7,621,397 B2
(45) Date of Patent: Nov. 24, 2009

(54) PACKAGING CONFIGURATIONS FOR CONSUMABLE PRODUCTS

(75) Inventors: Laura L. Boudrie, Appleton, WI (US); Ryan M. Patterson, Appleton, WI (US); George I. Nukuto, Neenah, WI (US); Catherine M. Hancock-Cooke, Neenah, WI (US); Janet E. Collins, Hortonville, WI (US); Pamela J. Hermans, Appleton, WI (US); Scott A. Baum, Hortonville, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 536 days.

(21) Appl. No.: 11/303,006

(22) Filed: Dec. 15, 2005

(65) Prior Publication Data

US 2007/0141207 A1 Jun. 21, 2007

(51) Int. Cl.
*B65D 85/00* (2006.01)
*B65D 73/00* (2006.01)
*B66C 1/10* (2006.01)

(52) U.S. Cl. ..... 206/391; 206/494; 206/497; 294/87.2

(58) Field of Classification Search ..... 206/432, 206/497, 139, 394, 391, 199, 150, 443, 427, 206/192, 494; 426/129; 294/87.2
See application file for complete search history.

(56) References Cited

U.S. PATENT DOCUMENTS 761,783 A 7/1904 Prudhomme
2,111,621 A 3/1938 Gerking et al.
2,644,631 A 7/1953 Petter
2,680,039 A * 6/1954 Burge ..... 206/150
2,813,602 A 11/1957 MacArthur, Jr.
2,849,110 A 8/1958 Weiss
2,931,491 A * 4/1960 Taylor ..... 206/431
3,224,575 A 12/1965 Whiteford
3,240,420 A 3/1966 Membrino
3,268,070 A 8/1966 Cunningham (Continued)

FOREIGN PATENT DOCUMENTS

EP 1352601 A2 10/2003

(Continued)

OTHER PUBLICATIONS

Hancock-Cooke-et al. U.S. Appl. No. 11/300,745, filed Dec. 15, 2005, Package for Consumable Products with Separately Sealed Compartments.

(Continued)

*Primary Examiner*—Stephen Garbe
*Assistant Examiner*—Kaushikkumar Desai
(74) *Attorney, Agent, or Firm*—Dority & Manning, P.A.

(57) ABSTRACT

A package for consumable products is disclosed. In one embodiment, the package includes a connecting member that connects a group of products together. The connecting member may comprise one or more bands that partially encircle the products or connect the products along a top surface. In addition, the package configuration may include a locking element that is configured to attach adjacent packages together or to attach the package to an adjacent structure, such as the railing of a shopping cart.

8 Claims, 4 Drawing Sheets

U.S. PATENT DOCUMENTS

| | | | | | |
|---|---|---|---|---|---|
| 3,277,628 | A | | 10/1966 | Harrison | |
| 3,300,041 | A | | 1/1967 | Fuller | |
| 3,360,179 | A | | 12/1967 | Carstens | |
| 3,369,655 | A | | 2/1968 | Harrison | |
| 3,460,671 | A | * | 8/1969 | Harm | 206/391 |
| 3,515,272 | A | * | 6/1970 | Von Gal | 206/192 |
| 3,752,305 | A | | 8/1973 | Heyne | |
| 3,822,012 | A | | 7/1974 | Weaver | |
| 4,050,216 | A | | 9/1977 | Stenberg | |
| 4,269,308 | A | * | 5/1981 | Platt | 206/150 |
| 4,289,236 | A | * | 9/1981 | Ganz et al. | 206/432 |
| 4,385,690 | A | * | 5/1983 | Olsen | 206/428 |
| 4,518,081 | A | | 5/1985 | de Larosiere | |
| 4,765,474 | A | | 8/1988 | James | |
| 4,779,731 | A | * | 10/1988 | Fujio | 206/432 |
| 4,865,208 | A | | 9/1989 | Lax et al. | |
| 5,048,687 | A | | 9/1991 | Suzuki et al. | |
| 5,154,288 | A | | 10/1992 | Glöyer | |
| 5,299,733 | A | | 4/1994 | Werth | |
| 5,353,900 | A | * | 10/1994 | Stilley | 206/279 |
| 5,452,798 | A | | 9/1995 | Kraft | |
| 5,685,428 | A | | 11/1997 | Herbers et al. | |
| 6,021,890 | A | * | 2/2000 | Focke et al. | 206/83.5 |
| 6,293,392 | B1 | | 9/2001 | Galbierz | |
| 6,578,724 | B1 | | 6/2003 | Owens | |
| 6,779,655 | B2 | | 8/2004 | Olsen et al. | |
| 6,834,762 | B2 | | 12/2004 | Krisko et al. | |
| 6,957,914 | B2 | | 10/2005 | Arends et al. | |
| 7,014,062 | B2 | | 3/2006 | Parris et al. | |
| 2003/0029752 | A1 | | 2/2003 | Terrell | |
| 2004/0043167 | A1 | | 3/2004 | Holzen et al. | |
| 2004/0055907 | A1 | * | 3/2004 | Marco | 206/150 |
| 2005/0194413 | A1 | | 9/2005 | Baker | |

FOREIGN PATENT DOCUMENTS

| | | | |
|---|---|---|---|
| EP | 1352601 | A3 | 10/2003 |
| WO | WO 03080440 | A1 | 10/2003 |
| WO | WO 03105622 | A1 | 12/2003 |

OTHER PUBLICATIONS

Nukuto et al. U.S. Appl. No. 11/303,043, filed Dec. 15, 2005, Carrier for Consumable Products.

* cited by examiner

PACKAGING CONFIGURATIONS FOR CONSUMABLE PRODUCTS

BACKGROUND OF THE INVENTION

Many consumable products, such as paper towels, bath tissue, diapers and related products, adult incontinence products, child training pants, feminine hygiene products, and the like are sometimes packaged and sold in relatively large quantities. There are many advantages to consumers for purchasing these types of products in greater amounts. For instance, these types of products are typically consumed rather quickly and having greater amounts reduces the need to return to the store. Another advantage to consumers when buying in relatively large quantities is that the price per unit is typically less than when buying in smaller quantities.

There are also various advantages to manufacturers in the ability to sell their products to consumers in relatively large quantities. In particular, there may be some cost and processing efficiencies in packaging the products into larger packages. Shipping and handling costs may also be reduced.

When sold in bulk, consumable products are typically packaged in large rectangular plastic film bags or are sold in cardboard boxes. Due to the size of these packages, however, the packages can be somewhat difficult for consumers to carry and hold. Also, such large packages can take up great amounts of space in shopping carts limiting the space in the cart for other products. As such, a need currently exists for an improved packaging design for packaging relatively large quantities of consumable products. In particular, a need exists for a bulk-type package for consumable products that is easy for consumers to carry and handle.

SUMMARY OF THE INVENTION

In general, the present disclosure is directed to various packaging configurations for consumable products. The packages are well suited to packaging relatively large quantities of one or more consumable products, although the packages may work equally well with smaller quantities. Of particular advantage, packages made according to the present disclosure can include easy to hold handles that allow relatively large quantities of a product to be transported. In one embodiment, the package may also be designed to be placed over an adjacent structure, such as the railing of a shopping cart. In this manner, at least one half of the product remains outside of the shopping cart thereby minimizing the amount of space the product occupies within the cart.

In an alternative embodiment, the package can include a locking element that is configured to engage a grid element on a shopping cart. In this manner, the entire package can be attached to the outside of the shopping cart and thus not occupy any space within the cart. Although various consumable products may be packaged according to the present disclosure, the packages are particularly well suited for containing tissue products, such as paper towels, facial tissues, bath tissues, and the like.

In one embodiment, for instance, the present disclosure is directed to a packaged consumable product that includes a first group of consumable products contained in a first subpackage and a second group of consumable products contained in a second subpackage, the first and second subpackages can generally have approximately the same height.

A connecting member comprising at least one band partially encircles the subpackages or is located on a top surface of the subpackages and holds them together. Specifically, the first subpackage is held together adjacent the second subpackage. The connecting member is configured to hold and connect together the first subpackage and the second subpackage at each end where the two subpackages meet. Further, the subpackages can be connected together at a height that is greater than about one half the height of the subpackages. For instance, the subpackages may be held together at a height that is greater than about 70% of the height of the subpackages, such as greater than about 80% of the height of the subpackages. In this manner, the two subpackages are partially separable from one another at an end opposite from where the connecting member is located. Thus, the packaged product can be placed over an adjacent structure in between the two subpackages. For example, the two subpackages may be placed over the railing of a shopping cart and thereby be supported by the cart.

In one embodiment, the first subpackage and the second subpackage are made from a polymer film, such as a shrink wrap film. The connecting member may comprise a single band that completely encircles the two subpackages. Alternatively, the connecting member may include two bands located at opposite ends of the package. For instance, in one embodiment, a first band can attach the two subpackages together at one end where the packages meet, while the second band can connect the two subpackages together at an opposite end. The bands may be attached to the subpackages using any suitable adhesive material or may be thermally bonded to the subpackages.

In one embodiment, the connecting member may be perforated at each end where the two subpackages meet so that a user can separate each subpackage from the other when desired.

Various different consumable products may be packaged according to the present disclosure. The packages, for instance, are well suited to holding tissue products, such as spirally wound bath tissue or spirally wound paper towels. Other products that may be packaged according to the present disclosure include facial tissues, diapers, adult incontinence products, training pants, disposable swimming pants, feminine hygiene products, and the like.

In an alternative embodiment of the present disclosure, a package is provided that contains a plurality of consumable products. In accordance with the present disclosure, a locking element is connected to the package that is configured to attach the package to the outside railing of a shopping cart or to attach adjacent packages together. The locking element, for instance, may comprise a stem attached to a wider tab member. The tab member can have a width greater than the width of a grid element located on a shopping cart. The tab member may be made from a material flexible enough to be inserted through the grid element. Once inserted through the grid element, the tab member supports the package on the outside of the shopping cart so that the product does not occupy any space within the cart.

In an alternative embodiment, the locking element may comprise a receiving member spaced from an engaging member. The engaging member may define an engaging element configured to be inserted into an opening defined by the receiving member. The engaging element, for instance, may have a width that is greater than the width of the opening defined by the receiving member. Once inserted into the opening, the engaging element thus locks the receiving member to the engaging member. In this manner, the receiving member and the engaging member may be placed around an adjacent structure on a shopping cart for holding the package to the shopping cart.

In still another embodiment, the locking element may comprise a pair of twist ties that can be used to secure the package to a shopping cart or to any other suitable adjacent structure.

The locking element can be connected to the package in any suitable manner. In one embodiment, for instance, the locking element may be attached to a connecting member that comprises one or more bands that encircle the plurality of consumable products.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
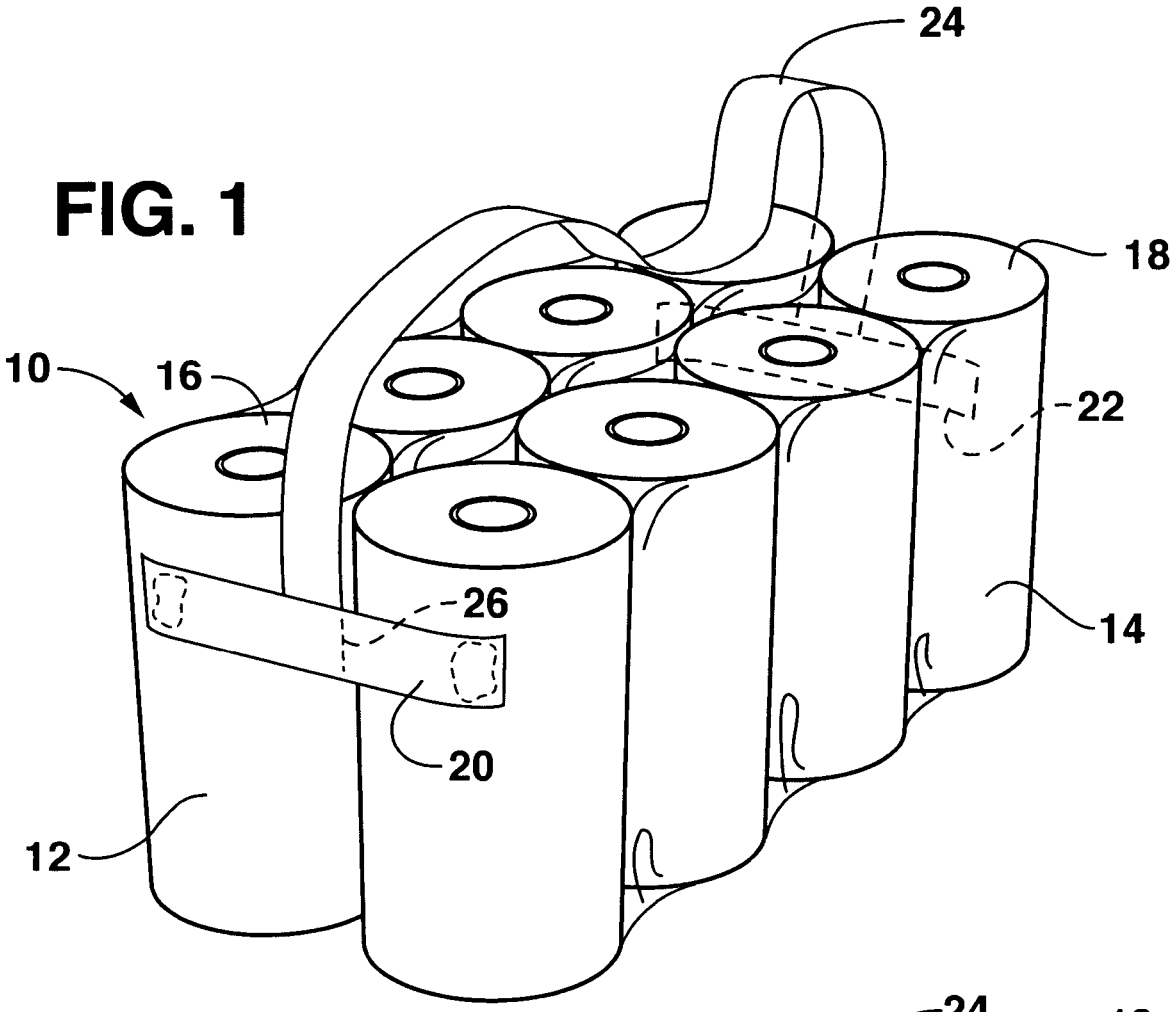
FIG. 1 is a perspective view of one embodiment of a package for consumable products made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

In general, the present disclosure is directed to a package for consumable products. In particular, the package is well suited to holding relatively large amounts of a consumable product while still being easy to handle and hold. It should be understood, however, that the package is also well suited to holding smaller amounts of a consumable product. The package of the present disclosure not only facilitates the ability of consumers to purchase consumable products in large bulk, but also provides a packing and shipping solution to manufacturers without substantially increasing the cost of the product.

As shown in the figures, the package configuration, in one embodiment, generally includes a connecting member that comprises at least one band. The band can completely encircle a plurality of products or, alternatively, can partially encircle the products.

In one particular embodiment, the package can include two or more subpackages that are held together by a connecting member. The connecting member can hold the subpackages together at or near one end of the subpackages. In this manner, the opposite ends of the subpackages are movable towards and away from each other. Thus, the subpackages can be slightly separated or divided and draped over an adjacent object, such as the railing of a shopping cart. Thus, the package can be supported on a shopping cart while only placing one half or less of the contents within the cart, thus preserving valuable cart space for the consumer.

In another embodiment, the package can include a locking element that is configured to attach the package to the outside railing of a shopping cart. Thus, as will be described in more detail below, the locking element when present on the package allows for the entire package to be placed and supported on the outside of the cart. In addition, the locking element may be configured so as to attach adjacent packages together for further facilitating the handling and transportation of the consumable product.

Referring to FIG. 1, for instance, one embodiment of a packaged consumable product generally 10 made in accordance with the present disclosure is shown. As illustrated, the product 10 includes, in this embodiment, a first subpackage 12 and a second subpackage 14. The first subpackage 12 contains a first group of consumable products 16, while the second subpackage 14 contains a second group of consumable products 18. The consumable products 16 may be the same or may be different than the consumable products 18. Further, the consumable products contained in each subpackage can be the same or different.

In the embodiment illustrated in FIG. 1, the first group of consumable products 16 and the second group of consumable products 18 comprise spirally wound tissue products, such as paper towels or bath tissue rolls. Further, each group contains four rolls of the tissue product. It should be understood, however, that each subpackage may contain more or less rolls. Further, the spirally wound rolls may be stacked on top of one another within the package, especially if the package is containing bath tissue.

In addition to spirally wound tissue products, it should be understood that the subpackages may contain various other consumable products. For instance, the subpackages may be configured to hold diapers, facial tissues, feminine hygiene products, training pants, adult incontinence products, and the like. In still other embodiments, the subpackages may contain auxiliary baby products such as wet wipes, disposable placemats, and other similar items.

The product groups 16 and 18 can be held together in a subpackage using any suitable material or configuration. For example, in one embodiment, each group of products can be wrapped or otherwise contained in a polymer film, such as a shrink wrap film as shown in FIG. 1. In addition to a shrink wrap film, however, the subpackages can be constructed from other types of polymer films, from paper materials, such as coated paper, from nonwoven webs, and the like.

For example, the subpackages may be made from a meltblown web, a spunbond web, or may be made from a laminate comprising spunbond webs, meltblown webs, and mixtures thereof.

In accordance with the present disclosure, the first subpackage 12 is attached to the second subpackage 14 by a connecting member which, in this embodiment, comprises a first band 20 located at one end of the package and a second band 22 located at an opposite end of the package. The bands 20 and 22 hold the first subpackage 12 adjacent to the second subpackage 14 at each end where the two subpackages meet. The bands 20 and 22 can be made from any suitable flexible, semi-rigid or rigid material. For example, in one embodiment, the bands can be made from a heavy grade polymer film. The polymer film may be made from, for instance, any suitable thermoplastic polymer. Such polymers may include, for instance, polyethylene, polypropylene, polystyrene, polycarbonate, copolymers thereof, and the like. In one embodiment, for instance, the bands 20 and 22 can be made from a low density polyethylene such as a linear low density polyethylene or from a high density polyethylene. The bands can be injection molded or die cut.

The thickness of the polymer film can also vary depending upon the particular application and the products being packaged. In one embodiment, for instance, the bands 20 and 22 can be made from a polymer film having a thickness of from about 1 mil (0.02 mm) to about 20 mil (0.5 mm), such as from about 3 mil (0.03 mm) to about 6 mil (0.2 mm).

The bands 20 and 22, in this embodiment, are attached to the subpackages using an adhesive composition. More particularly, the bands 20 and 22 are attached to the outer surface of the subpackages 12 and 14. In general, any suitable adhesive composition may be used in order to attach the bands to the subpackages. In addition, the bands can be attached to the subpackages using any other suitable technique, such as through thermal bonding or ultrasonic bonding.

Once attached to the subpackages, the bands 20 and 22 may serve as handles for the package. Alternatively, the product can include an additional handle, such as a strap 24. As shown, the strap 24 is connected to each of the bands 20 and 22. In other embodiments, however, a handle may be placed on the package at other locations. For instance, a handle can be attached to the top of the subpackages or to the side of one of the subpackages as opposed to being connected to the bands 20 and 22.

As shown in FIG. 1, the first band 20 and the second band 22 are connected to the subpackages 12 and 14 at a height that is greater than about one half the height of the subpackages. For example, the bands 20 and 22 may be located at a height that is greater than about 70% of the height of the subpackages, such as greater than about 80% of the height of the subpackages.

Figure 2:
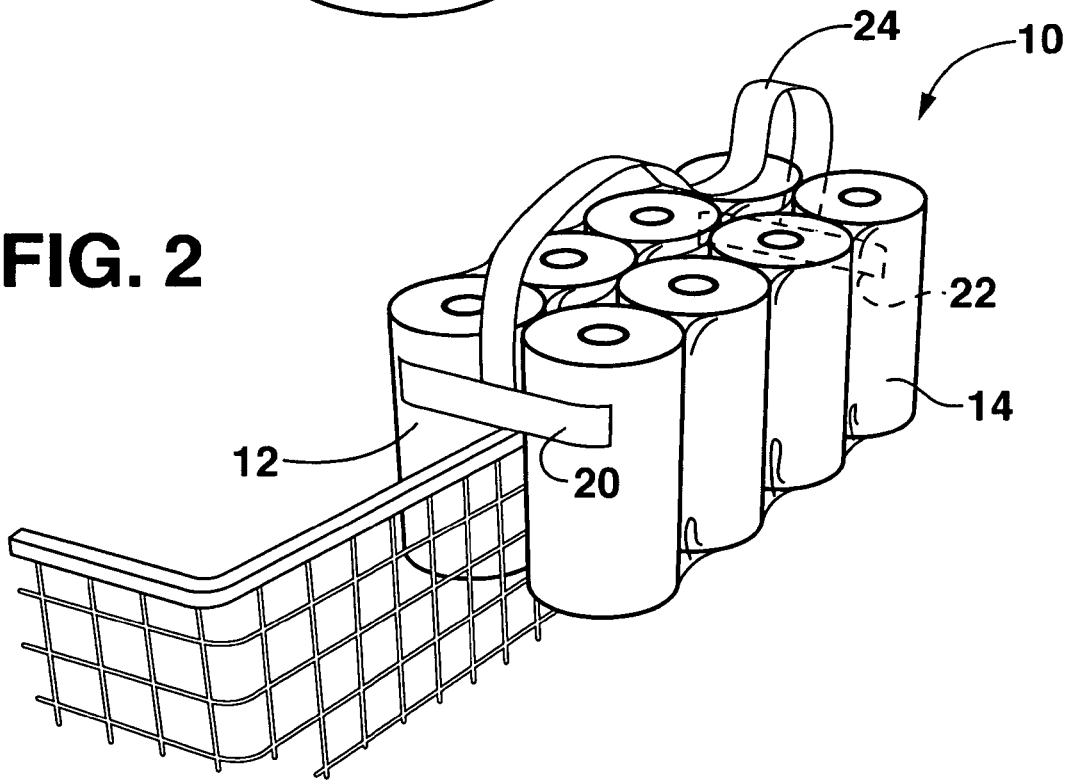
FIG. 2 is a perspective view of the package illustrated in FIG. 1 draped over the railing of a grocery cart.

Connecting the bands 20 and 22 at a height that is about one half the height of the subpackages or greater can provide various benefits and advantages. For instance, by connecting the two subpackages together at one end as shown in FIG. 1, allows the opposite end of the subpackages to slightly move towards and away from each other. Thus, as shown in FIG. 2, each of the subpackages may be draped over the wall or railing of a grocery cart for transporting the package through a retail store. In this manner, the consumable product only takes up one half of the space in the grocery cart in comparison to if the consumable product was contained all in a single rectangular package. Further, the package can be printed or otherwise display the manufacturer's product name and logo. In this manner, the manufacturer of the consumable product gains a benefit by having the package displayed on the grocery cart as the cart is moved through the store.

In addition to the railing of a grocery cart, it should be understood that the package can also be draped over various other structures. For instance, the package can be draped over a bar on a bicycle or may be draped over a structure contained in a vehicle for maintaining the package in a certain location.

When being draped over an adjacent structure as shown in FIG. 2, the groups of consumable products can be contained in the subpackages in a manner that creates balance in relation to the first and second bands 20 and 22. For instance, once the subpackages 12 and 14 are filled with one or more consumable products, the subpackages can have substantially the same weight so as to provide a balanced overall package. For instance, the weight of the first subpackage 12 may be within about 20%, such as within about 10%, such as within about 5% of the weight of the second subpackage 14. Similarly, the volume in each subpackage may be substantially the same depending upon the consumable products being packaged. For instance, the volume of the first subpackage 12 may be within about 20%, such as within about 10%, such as within about 5% of the volume of the second subpackage 14.

Referring back to FIG. 1, in one embodiment, each of the bands 20 and 22 can include a perforation line, such as perforation line 26. The perforation line 26 is for separating the first subpackage 12 from the second subpackage 14 after the product has been purchased. In this manner, a consumer can separate the subpackages and place them in different locations if desired.

Figure 3:
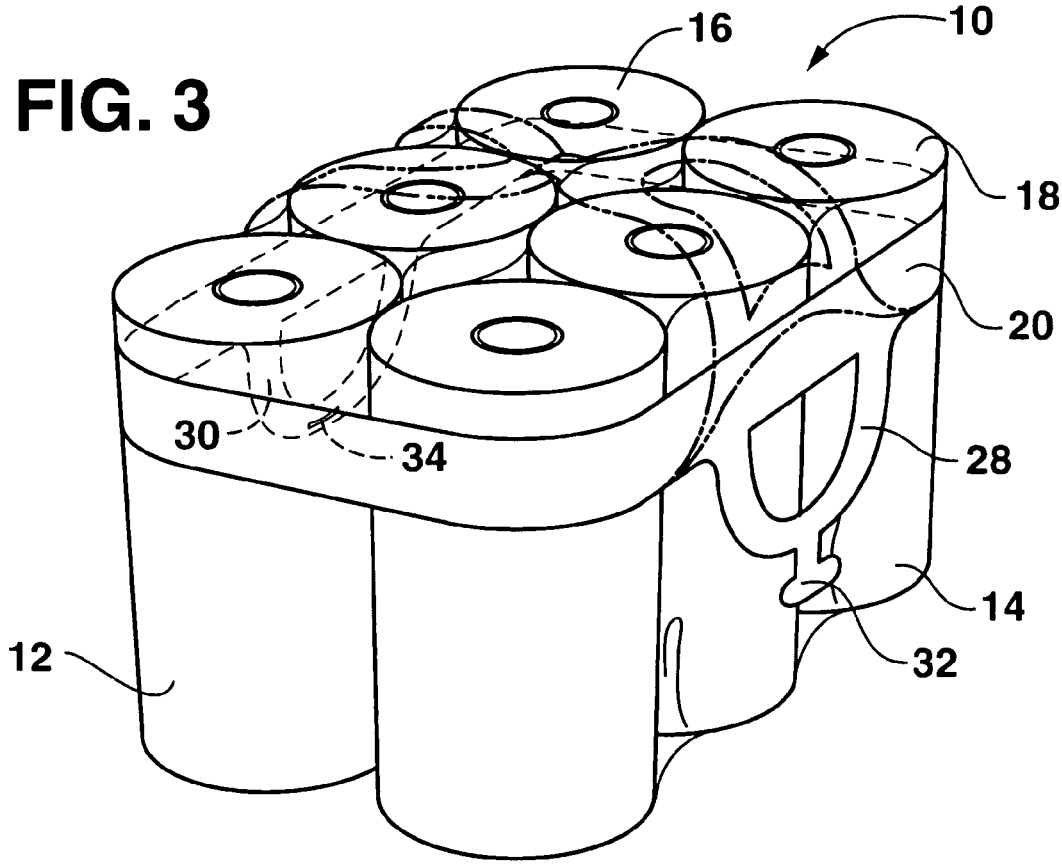
FIG. 3 is a perspective view of another embodiment of a package for consumable products made in accordance with the present disclosure.

Referring to FIG. 3, another embodiment of a package for consumable products is illustrated. Like reference numerals have been used to indicate the same or similar elements.

Similar to the embodiment shown in FIG. 1, the package 10 illustrated in FIG. 3 includes a first subpackage 12 containing a first group of consumable products 16 and a second subpackage 14 containing a second group of consumable products 18. A connecting member is used to hold the two subpackages together. In this embodiment, the connecting member comprises a single band 20 that completely encircles both subpackages 12 and 14. The band 20 can tightly hold the two subpackages together at a height sufficient to allow the subpackages to be draped over an adjacent structure, such as the railing of a shopping cart.

The band 20 as shown in FIG. 3 can be made from the same materials as described above with respect to the bands illustrated in FIG. 1. In one embodiment, the band 20 as shown in FIG. 3 can be made from a shrinkable film that, once placed around the consumable products, can be exposed to an energy source that causes the band to shrink and tightly hold the products together. The energy source used to shrink the film, for instance, may comprise heat, microwaves, or any other suitable energy source.

It should be understood that the package 10 may include more than the two subpackages illustrated. For instance, in an alternative embodiment, the consumable products may be broken up into a greater or lesser amount of subpackages. For instance, each spirally wound tissue product shown in FIG. 3 may be individually wrapped and contained with the package 10. In still another alternative embodiment, each of the individual tissue products may not even be contained within a separate wrapper. The tension placed around the consumable products by the band 20 can be increased in order to maintain the separate subpackages or separate products together.

The band 20 can itself serve as a handle for picking up and transporting the package. Alternatively, as shown in FIG. 3, the package 10 may be equipped with a separate handle. For example, in the embodiment illustrated, a first strap 28 is attached on one end to the band 20, while a second strap 30 is connected to the band 20 at an opposite end. The straps 28 and 30 can include openings that, once the straps are brought together, can cooperate to form a handle for transporting and carrying the package.

In addition, in one embodiment, the first and second straps 28 and 30 can include a locking element for locking the two straps together. For instance, as shown in FIG. 3, the first strap 28 includes an engaging member 32, while the second strap 30 includes a receiving member 34 comprising an opening or slot. As shown in phantom, the engaging member 32 can be inserted into the receiving member 34 for locking the first strap to the second strap.

One particular advantage to the configuration illustrated in FIG. 3 is that the engaging member 32 located on the strap 28 can also be used to attach the product 10 to an adjacent product. More particularly, the engaging member 32 can be inserted into a receiving member on an adjacent and similar package. In this manner, two similar packages can be attached together and the strap 28 can form a handle with an adjacent strap on the adjacent package. Further, the two packages interconnected together may be placed over the railing of a shopping cart so that the railing of the shopping cart is positioned in between the two packages. Thus, one package would remain inside the cart, while the adjacent package would remain completely on the outside of the cart.

The package configuration as shown in FIG. 3, in one embodiment, may be used to package different consumable products. In this manner, two packages may be interlocked together wherein each package contains a different product. Thus, the two products can be locked together as a single package for easily handling and transporting the different products.

Figure 4A:
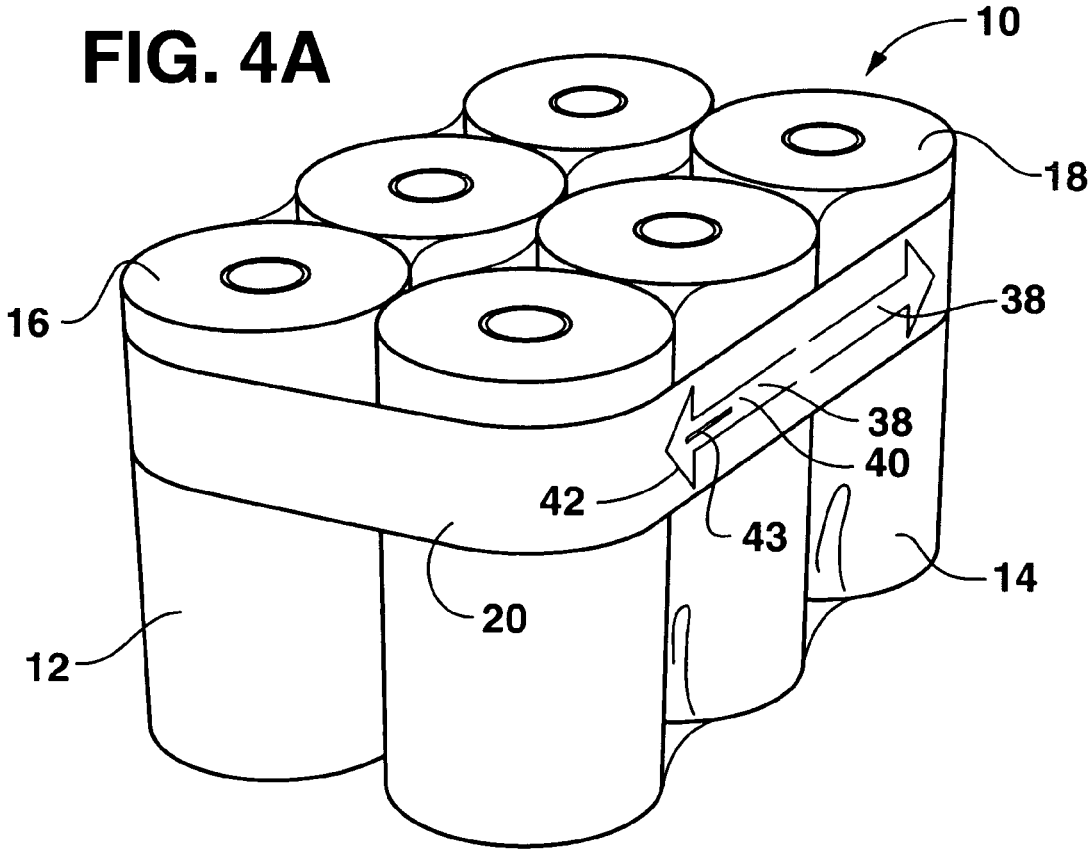
FIGS. 4A and 4B are perspective views of still another embodiment of a package for consumable products made in accordance with the present disclosure.
Figure 4B:
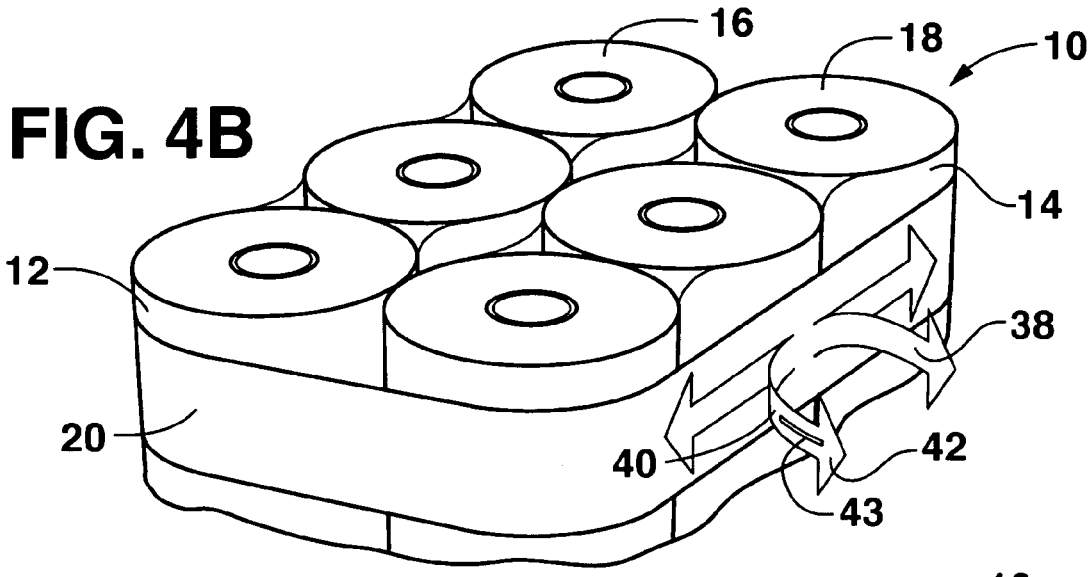

Referring to FIGS. 4A and 4B, still another embodiment of a packaging configuration made in accordance with the present disclosure is illustrated. Again, like reference numerals have been used to indicate similar elements.

As shown in FIGS. 4A and 4B, in this embodiment, a package 10 is illustrated including a first subpackage 12 containing a first group of consumable products 16, such as a group of spirally wound tissue products. The package 10 further includes a second subpackage 14 also containing a group of consumable products 18. Similar to the embodiments shown in FIG. 3, the subpackages are held together by a single band 20 that completely encircles all of the products. It should be understood, that the package 10 may include more or less subpackages. In fact, each of the consumable products may be separately contained within the package.

In the embodiment illustrated in FIGS. 4A and 4B, the package 10 further includes a plurality of locking elements 38 that are located along the bands 20. The locking elements 38 are configured to attach the package 10 to an adjacent structure, such as to the outside railing of a shopping cart so as to conserve the amount of space contained within the cart while shopping.

In the embodiment illustrated in FIGS. 4A and 4B, the locking elements 38 comprise a stem 40 connected to a wider tab member 42 that, in this embodiment, is in the shape of an arrow. The locking elements 38 can generally be made from a flexible material. For instance, in the embodiments illustrated, the locking elements 38 are integral with the band 20 and are present on the band by, for instance, die cutting the shape into the band material.

In order to attach the package 10 to the outside railing of a shopping cart, the tab member 42 has a size that is greater than the width of a grid element located on a shopping cart. For instance, the tab member 42 may have a width of greater than about 2 inches, such as greater than about 3 inches, such as greater than about 4 inches. It should be understood, however, that the actual dimensions of the tab member 42 will depend upon the particular grid element from which the product is to hang.

The locking element 38 is made generally from a flexible material. In particular, the material is flexible enough so that the tab member 42 may be compressed and inserted through the grid element on a shopping cart even though the tab member is wider than the grid element. Once inserted through the grid element, the wider tab member 42 expands and engages the opposite side of the railing and allows the package 10 to hang from the outside surface of the cart.

In addition to being suspended from a shopping cart, it should be understood that the locking element 38 may have any suitable configuration that will allow the package 10 to also be suspended from other adjacent structures, such as from wire shelving or a janitor's cart. Further, even though an arrow shape is illustrated in FIGS. 4A and 4B, the tab member 42 may have any suitable shape that will allow the locking element to engage a desired surface or structure.

In FIGS. 4A and 4B, the locking element 38 is shown integral with the band 20. It should be understood, however, that the locking elements 38 may be connected to the package 10 in any suitable location and used in any suitable manner. For instance, the locking elements may be attached at other points on the package or can be attached to the band 20 using, for instance, an adhesive material or may be otherwise bonded to the band 20 using any suitable technique, such as thermal bonding or ultrasonic bonding.

It should also be understood that the locking element 38 can virtually be used in combination with any suitable packaging configuration and is not to be limited for use exclusively with a packaging configuration that includes an encircling band such as shown in the figures.

In still another alternative embodiment, the band 20 or the locking element itself may also include an opening or slit that is capable of receiving the tab member 42. For instance, as shown in FIGS. 4A and 4B, the locking element 38 defines a slit 43. In this manner, a tab member 42 from an adjacent locking element may be inserted in the slit 43 for forming a loop on the band 20. The loop can then be used as a handle or can be used to suspend the package over a structure that has a diameter less than the diameter of the loop. As can be appreciated, by including corresponding slits on the band 20, multiple packages 10 may also be connected together as desired.

Figure 4C:
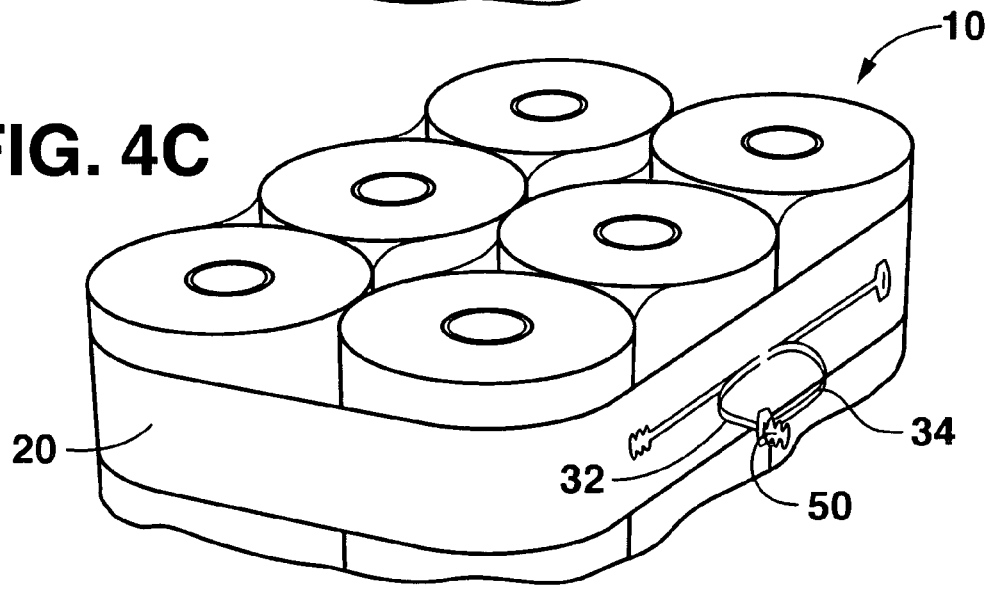
FIG. 4C is a perspective view of another embodiment of a package for consumable products made in accordance with the present disclosure.

Referring to FIG. 4C, still another embodiment of a package 10 made in accordance with the present disclosure is illustrated. In this embodiment, the package 10 includes a band 20 that encircles a group of consumable products. The band 20 is connected to a locking element that allows the package 10 to be fastened around an adjacent structure, such as the bar of a shopping cart so that the package can hang on the outside of the cart.

More particularly, in this embodiment, the locking element includes an engaging member 32 spaced from a receiving member 34. The engaging member 32 includes a wider tab portion 50. The receiving member 34, on the other hand, defines an opening that is configured to receive the tab portion 50. Specifically, once the tab portion 50 is placed through the opening in the receiving member 34, the receiving member becomes connected to the engaging member.

Once the engaging member 32 is connected to the receiving member 34, the two structures can act as a handle for carrying the package. Also, as described above, the engaging member 32 and the receiving member 34 may be wrapped around an adjacent structure for suspending the package, such as from the outside railing of a shopping cart.

In the embodiment shown in FIG. 4C, the engaging member 32 and the receiving member 34 are integral with the band 20. It should be understood, however, that the engaging member 32 and the receiving member 34 may be attached to the band 20 using any suitable technique or may be otherwise located on the package at any desirable location.

Figure 4D:
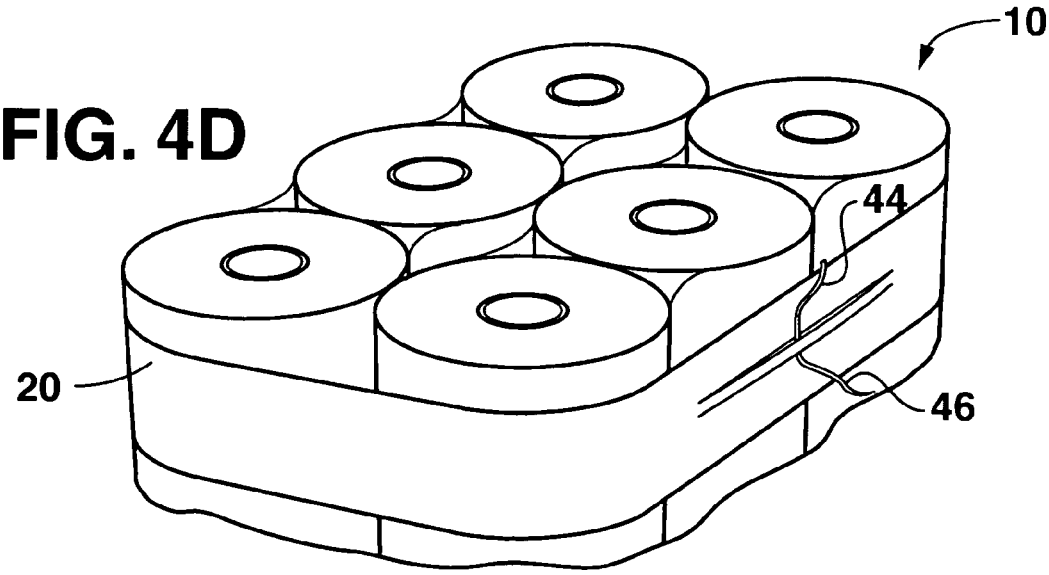
FIG. 4D is yet another embodiment of a package for consumable products made in accordance with the present disclosure.

Referring to FIG. 4D, still another embodiment of a package 10 made in accordance with the present disclosure is illustrated. In this embodiment, the package 10 includes a single band 20 that encircles a plurality of consumable products. Connected to the band 20 is a locking element for suspending the package from, for instance, the outside railing of a shopping cart. In this embodiment, the locking element comprises a pair of twist ties. Specifically, the band 20 is connected to a first twist tie 44 and to a second twist tie 46.

The twist ties 44 and 46 are capable of being attached together by a twisting motion for either forming a handle on the package or for attaching the package to some other structure. The twist ties 44 and 46 can be made from any suitable material that possesses some malleability. For instance, the twist ties 44 and 46 can have a wire core and a plastic sheath.

Figure 5A:
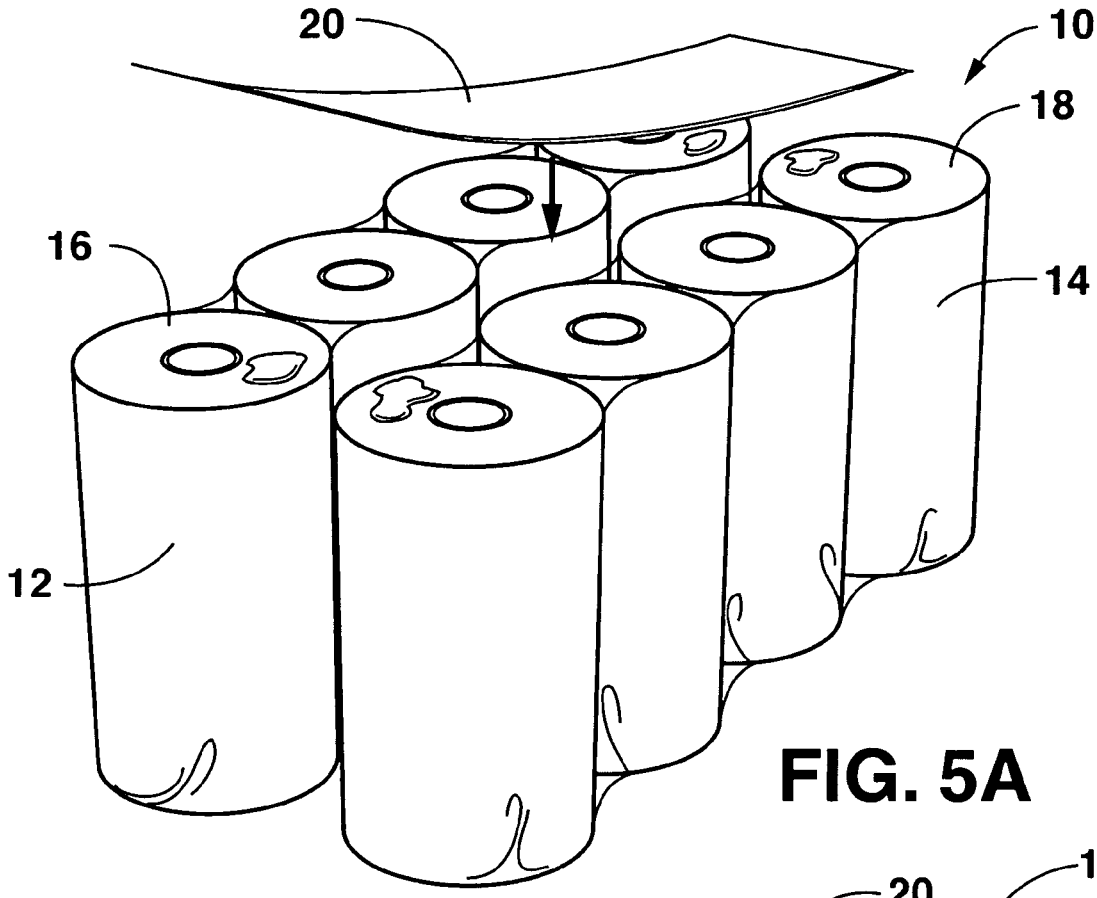
FIGS. 5A and 5B are perspective views of still another embodiment of a package for consumable products made in accordance with the present disclosure.
Figure 5B:
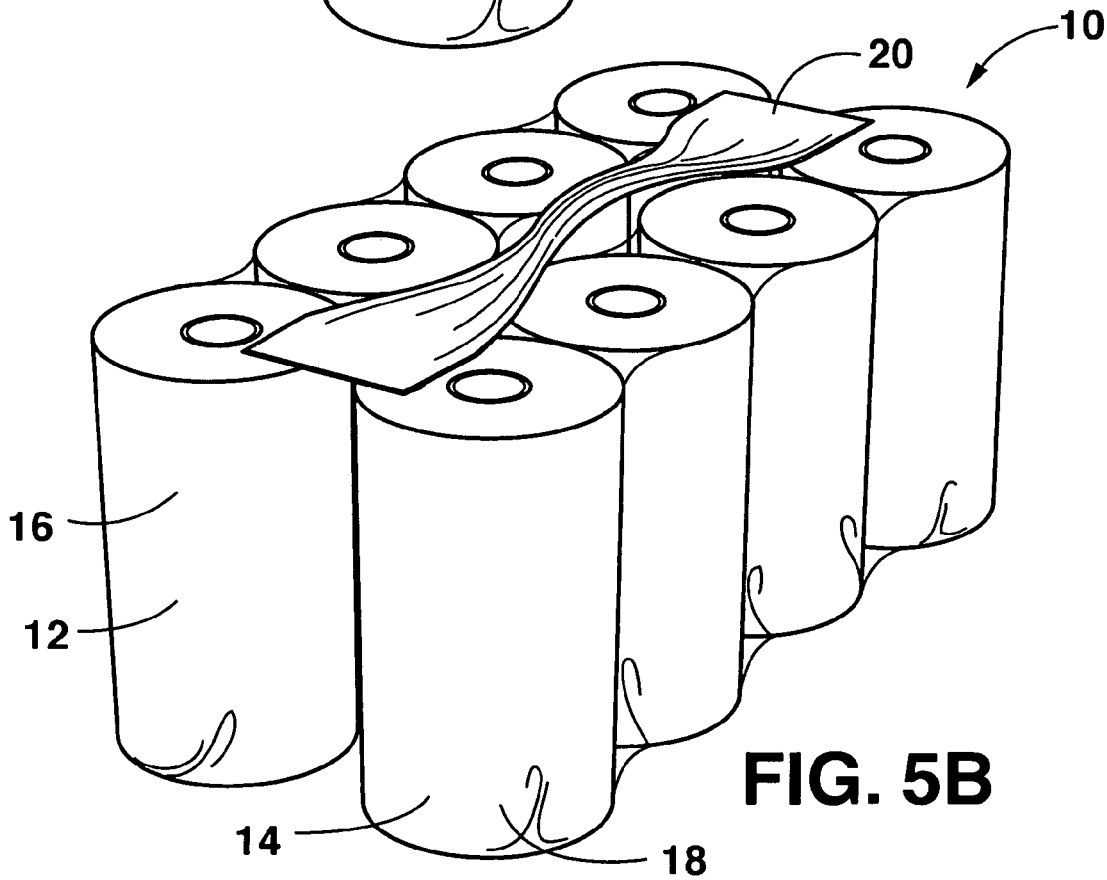

Referring now to FIGS. 5A and 5B, still another embodiment of a packaging configuration made in accordance with the present disclosure is illustrated. As before, like reference numerals have been used to indicate the same or similar elements.

As shown in FIGS. 5A and 5B, the package 10 includes a first subpackage 12 containing a first group of consumable products 16 and a second subpackage 14 containing a second group of consumable products 18. In order to hold or attach the two subpackages 12 and 14 together, the package 10 includes a band 20 that, in this embodiment, is attached to the top of the subpackages.

For example, as shown in FIG. 5A, the band 20 can be attached to the top of each of the subpackages using an adhesive material. In general, any suitable adhesive material may be used in order to adhere the band 20 to each of the subpackages 12 and 14. In addition to using an adhesive material, the band 20 may be attached to the subpackages using any other suitable technique. For instance, in alternative embodiments, the band 20 can be thermally bonded or ultrasonically bonded to the subpackages.

As shown in the figures, the band 20 is connected to the subpackages at opposite ends of the band. By only connecting the band 20 at opposite ends to the subpackages, as shown in FIG. 5B, an opening is created in between the middle of the band 20 and the top of the subpackages. In this manner, the band 20 not only holds the two subpackages together, but also creates a convenient handle for the package 10.

In addition, by only connecting the subpackages at the top surface, the opposite ends of the subpackages are free to move towards and away from each other. Thus, the two subpackages may be draped over an adjacent structure, such as the railing of a shopping cart.

The band 20 can be made from any suitable material. For instance, the band 20 as shown in FIGS. 5A and 5B may be made from a polymer film, a rigid or semi-rigid polymeric material, from a paper material such as a paperboard, or from a textile material. The textile material, for instance, may comprise a woven, knitted, or nonwoven fabric. In one embodiment, for instance, the band 20 can be made from one or more nonwoven webs comprising meltblown webs, spunbond webs, and the like.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A packaged consumable product comprising:

a first group of consumable products contained in a first subpackage and a second group of consumable products contained in a second subpackage, the first and second subpackages having a height, the height of the first subpackage being about the same as the height of the second subpackage;

a connecting member comprising at least one band that at least partially encircles the subpackages or is located on a top surface of the subpackages, the connecting member holding and connecting together the first subpackage adjacent to the second subpackage at least at each end where the two subpackages meet, the subpackages being connected together at a height that is greater than about one-half the height of the subpackages so that the two subpackages can separate from one another at an end opposite where the connecting member is located and an adjacent structure can be placed in between the two subpackages for supporting the packaged product; wherein the first and second subpackages are not connected to each other below the at least one band; and wherein the first subpackage and the second subpackage are made from a polymer film, paper materials, or nonwoven webs.

2. A packaged consumable product as defined in claim 1, wherein the connecting member comprises a first band that attaches the first subpackage to the second subpackage at one end and a second band that attaches the first subpackage to the second subpackage at an opposite end.

3. A packaged consumable product as defined in claim 1, wherein the connecting member partially encircles the subpackages and is perforated at each end where the two subpackages meet for allowing a user to separate the first subpackage from the second subpackage.

4. A packaged consumable product as defined in claim 1, wherein the subpackages are connected together by the connecting member at a height that is at least 70% of the height of the subpackages.

5. A packaged consumable product as defined in claim 1, wherein the subpackages are connected together by the connecting member at a height that is at least 80% of the height of the subpackages.

6. A packaged consumable product as defined in claim 1, wherein the connecting member comprises a polymer film having a thickness of at least about 0.05 mm.

7. A packaged consumable product as defined in claim 1, wherein the first group of consumable products and the second group of consumable products both comprise spirally wound tissue products.

8. A packaged consumable product as defined in claim 1, wherein the first group of consumable products and the second group of consumable products comprises diapers, tissue products, adult incontinence products, training pants, disposable swimming pants, or feminine hygiene products.

* * * * *

UNITED STATES PATENT AND TRADEMARK OFFICE

CERTIFICATE OF CORRECTION

PATENT NO. : 7,621,397 B2
APPLICATION NO. : 11/303006
DATED : November 24, 2009
INVENTOR(S) : Boudrie et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 880 days.

Signed and Sealed this

Twenty-sixth Day of October, 2010

David J. Kappos

David J. Kappos
*Director of the United States Patent and Trademark Office*